US005717994A

United States Patent [19]

Goldsmith

[11] Patent Number: 5,717,994

[45] **Date of Patent: *Feb. 17, 1998**

[54] SPORTS CATCH GLOVE WITH STIFFNER

[75] Inventor: Edward Michael Goldsmith, Bloomfield, Mich.

[73] Assignee: Mike Vaughn Custom Sports, Inc., Lake Orion, Mich.

[ * ] Notice: The term of this patent shall not extend beyond the expiration date of Pat. No. 5,551,083.

[21] Appl. No.: 703,199

[22] Filed: Aug. 26, 1996

Related U.S. Application Data

[63] Continuation of Ser. No. 496,024, Jun. 28, 1995, Pat. No. 5,551,083.

[51] Int. Cl.[6] ..... A41D 13/10

[52] U.S. Cl. ..... 2/19; 2/161.1

[58] Field of Search ..... 2/19, 159, 161.1, 2/161.2, 163, 16, 18, 158, 160, 161.6, 164

[56] References Cited

U.S. PATENT DOCUMENTS

| | | | |
|---|---|---|---|
| 967,120 | 8/1910 | Gamble | 2/19 |
| 1,465,830 | 8/1923 | Raymond | 2/19 |
| 3,300,787 | 1/1967 | Denkert | 2/19 |
| 3,605,117 | 9/1971 | Latina | 2/16 |
| 4,027,339 | 6/1977 | Brucker | 2/16 |
| 4,197,592 | 4/1980 | Klein | 2/19 |
| 4,497,073 | 2/1985 | Deutsch | 2/19 |
| 4,541,127 | 9/1985 | Gould | 2/16 |
| 4,665,561 | 5/1987 | Aoki | 2/19 |
| 4,843,561 | 6/1989 | Gramza et al. | 2/16 |
| 4,896,376 | 1/1990 | Miner | 2/16 |
| 4,928,320 | 5/1990 | Aoki | 2/19 |
| 4,967,418 | 11/1990 | Marcotte | 2/16 |
| 5,012,529 | 5/1991 | Murai | 2/16 |
| 5,031,238 | 7/1991 | Hayes | 2/16 |
| 5,075,899 | 12/1991 | Funhashi et al. | 2/16 |
| 5,107,544 | 4/1992 | Capatosto | 2/16 |
| 5,379,549 | 1/1995 | Williams, Jr. | 2/16 |
| 5,402,537 | 4/1995 | Kolada | 2/16 |
| 5,425,142 | 6/1995 | Scott | 2/16 |
| 5,575,005 | 11/1996 | Walker et al. | |

FOREIGN PATENT DOCUMENTS

| | | | |
|---|---|---|---|
| 2036824 | 8/1992 | Canada | 2/16 |

*Primary Examiner*—C. D. Crowder
*Assistant Examiner*—Larry D. Worrell, Jr.
*Attorney, Agent, or Firm*—James L. Ewing, IV; Kilpatrick Stockton LLP

[57] ABSTRACT

A sports catch glove according to the present invention offers superior control and effectiveness over conventional catch gloves. The glove incorporates a dished tensegrity stiffener in its distal finger portion that weighs less but is more than ten times stiffer than stiffeners employed in conventional gloves. To allow the wearer to gain maximum benefit from this added stiffness in the distal finger portion, the glove also incorporates a close-fitting inner glove, at least a portion of which is made of an elastomeric material. The inner glove keeps the wearer's hand more closely coupled to the glove than in conventional gloves, thus allowing the wearer to maintain control over the glove under the severe forces imposed when catching fast-moving, hard objects.

15 Claims, 6 Drawing Sheets

SPORTS CATCH GLOVE WITH STIFFNER

This application is a continuation of Ser. No. 08/496,024, filed Jun. 28, 1995 now U.S. Pat. No. 5,551,083.

This invention relates to sports catch gloves including a hockey goalie's catch glove among others. Such gloves allow a sports participant to catch objects that are often hard and moving fast.

BACKGROUND OF THE INVENTION

Hockey goalies and all baseball and softball players, among other sports participants, use catch gloves to catch hard objects moving at high speeds. The interior of a conventional catch glove typically consists of finger stalls to contain the wearer's fingers, a thumb stall to contain the wearer's thumb, and straps for the wearer's smallest finger and thumb to provide added control over the glove. These finger and thumb stalls and straps are typically made of leather, synthetic leather, or another flexible material that resists substantial elastic stretching. Because these materials resist stretching, the finger stalls and thumb stall of conventional catch gloves fit somewhat loosely around the fingers and thumb.

Additionally, the proximal portion of the hand from the wrist to a line joining approximately the mid-points of the proximal phalanges of the fingers is not immediately covered by any material. Thus, the palm of the wearer's hand is not kept in close contact with the glove. The relatively loose fitting finger and thumb stalls and exposed portion of the hand are employed in conventional catch gloves to allow the glove to close without binding on the wearer's hand. However, the loose fitting finger and thumb stalls and exposed portion of the hand reduce the wearer's control over the glove.

In an attempt to couple the wearer's hand more closely to the glove and increase the wearer's control over the glove, some manufacturers construct gloves with tighter fitting finger and thumb stalls. However, closing the glove causes these tighter fitting stalls to flatten against the wearer's fingers and thumb and bind on the wearer's fingers and thumb. This flattening and binding prevents the wearer from closing the glove easily. Thus, the wearer's control over a glove with these tighter-fitting finger and thumb stalls is actually reduced over a conventional glove with more loosely fitting finger and thumb stalls.

The external surfaces of a conventional catch glove are most often flexible materials similar to those used in the interior including leather, synthetic leather, and nylon, all of which also resist substantial elastic stretching. To increase the stiffness of the distal finger portion of a conventional catch glove, a plastic stiffener is sometimes inserted into the interior of this finger portion. This stiffener is typically shaped approximately like a quarter of a circular disc with a single linear bend that is approximately perpendicular to the wearer's fingers when the glove is being worn. Even with this stiffener, the distal edge of a conventional catch glove is sometimes too flexible to enable the wearer to successfully catch a puck or ball that strikes the glove near its distal edge.

SUMMARY OF THE INVENTION

A sports catch glove according to the present invention, unlike a conventional catch glove, contains at least a substantial portion of the wearer's hand with an elastomeric material. The elastomeric material stretches enough to allow the glove to close easily, but also keeps the hand in closer contact with the glove.

Use of the elastomeric material also allows any portion of the finger and thumb stalls that is made of conventional materials to fit more tightly around the wearer's fingers. As the glove is closed, the elastomeric material stretches enough to prevent the finger and thumb stalls from flattening against and binding on the wearer's fingers. Thus, the wearer has superior control over the catch glove of the present invention because the finger and thumb stalls are tighter and the palm and rest of the anterior portion of the hand is in closer contact with the glove than with a conventional catch glove. The catch glove of the present invention is also substantially more comfortable to wear because the elastomeric material allows for a secure fit without being too tight and accommodates a wider range of hand sizes.

A sports catch glove according to the present invention also employs a stiffener in the distal finger portion that is bent along two or more axes into a generally shell-like shape, which significantly increases its stiffness over a conventional stiffener. This compound bend also more effectively deflects objects into the center pocket of the glove because it is bent toward the interior of the glove at a sharper angle than a conventional stiffener. Thus, the wearer's control over the glove and catching ability is increased because the distal portion of the glove does not bend significantly when struck by the object to be caught and the object is deflected toward the center pocket of the glove.

It is therefore an object of the present invention to provide a sports catch glove of superior comfort that allows a greater degree of control over the glove by including a relatively tight fitting inner glove, a portion of which is made of an elastomeric material.

It is a further object of the present invention to provide a sports catch glove with superior catching performance by having more stiffness along its distal edge and a distal finger portion that bends in toward the center pocket of the glove.

Other objects, features, and advantages of the present invention will become apparent with reference to the remainder of this document.

DETAILED DESCRIPTION OF THE DRAWINGS

Figure 1:
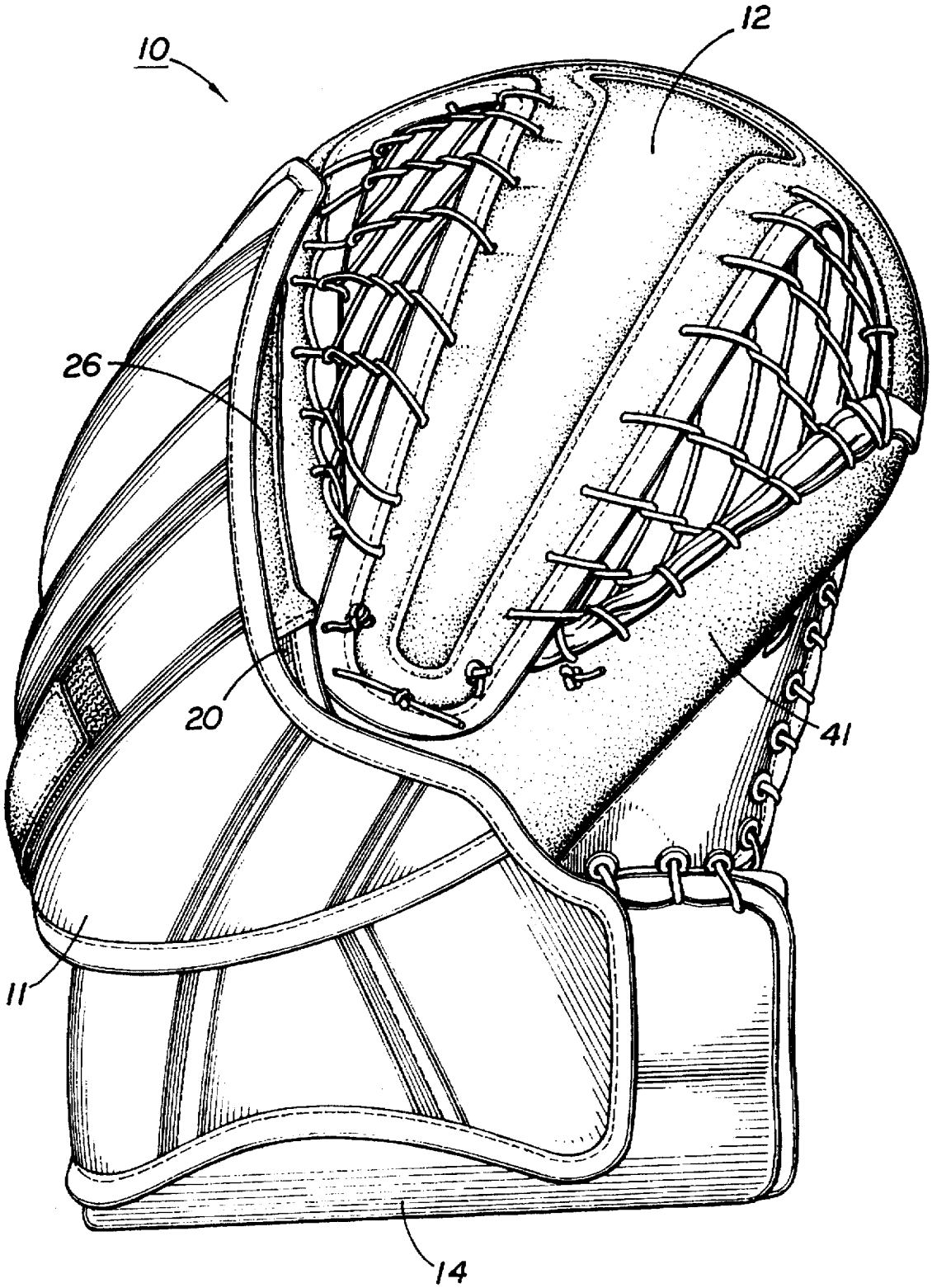
FIG. 1 is a perspective view of the convex non-catching side of a preferred embodiment of a hockey goalie's glove according to the present invention.

FIG. 1 illustrates the generally convex non-catching side of a hockey goalie's catch glove 10 according to the present invention comprising, among other components, outer facing 11, web 12, blocker pad 14, inner glove substructure 20, and thumb stall 41.

Figure 2:
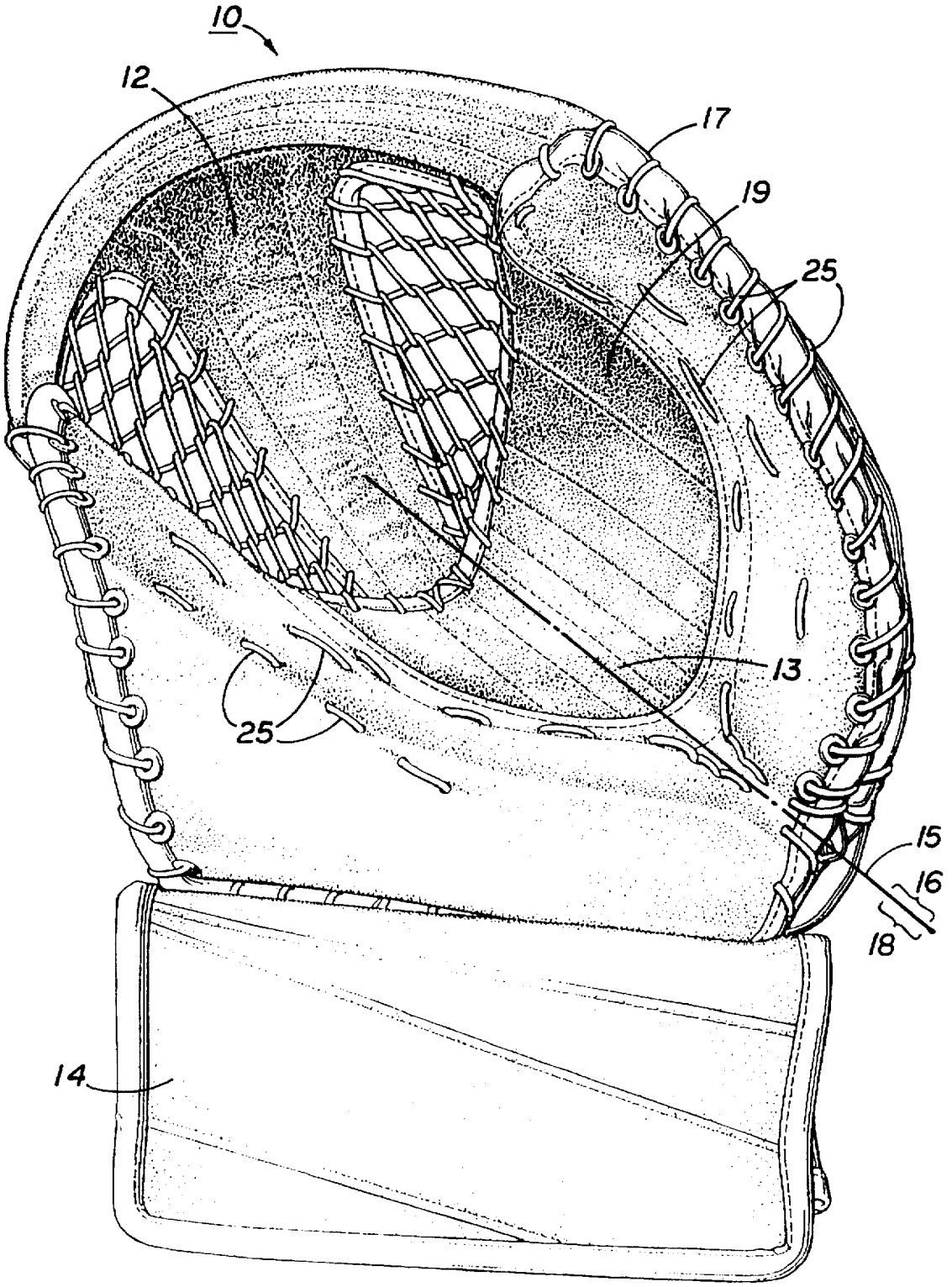
FIG. 2 is a perspective view of the concave catching side of the glove of FIG. 1.

FIG. 2 illustrates the generally concave inner facing 19 of glove 10. The wearer catches a hockey puck in web 12 or pocket portion 13. Pocket portion 13 and web 12 bend along articulation axis 15 as the wearer closes glove 10. Articulation axis 15 divides glove 10 into finger portion 16 that is distal to articulation axis 15 and thumb portion 18 that is proximal to articulation axis 15. Lacing 25 holds various components of glove 10 together as will become apparent below.

Figure 3:
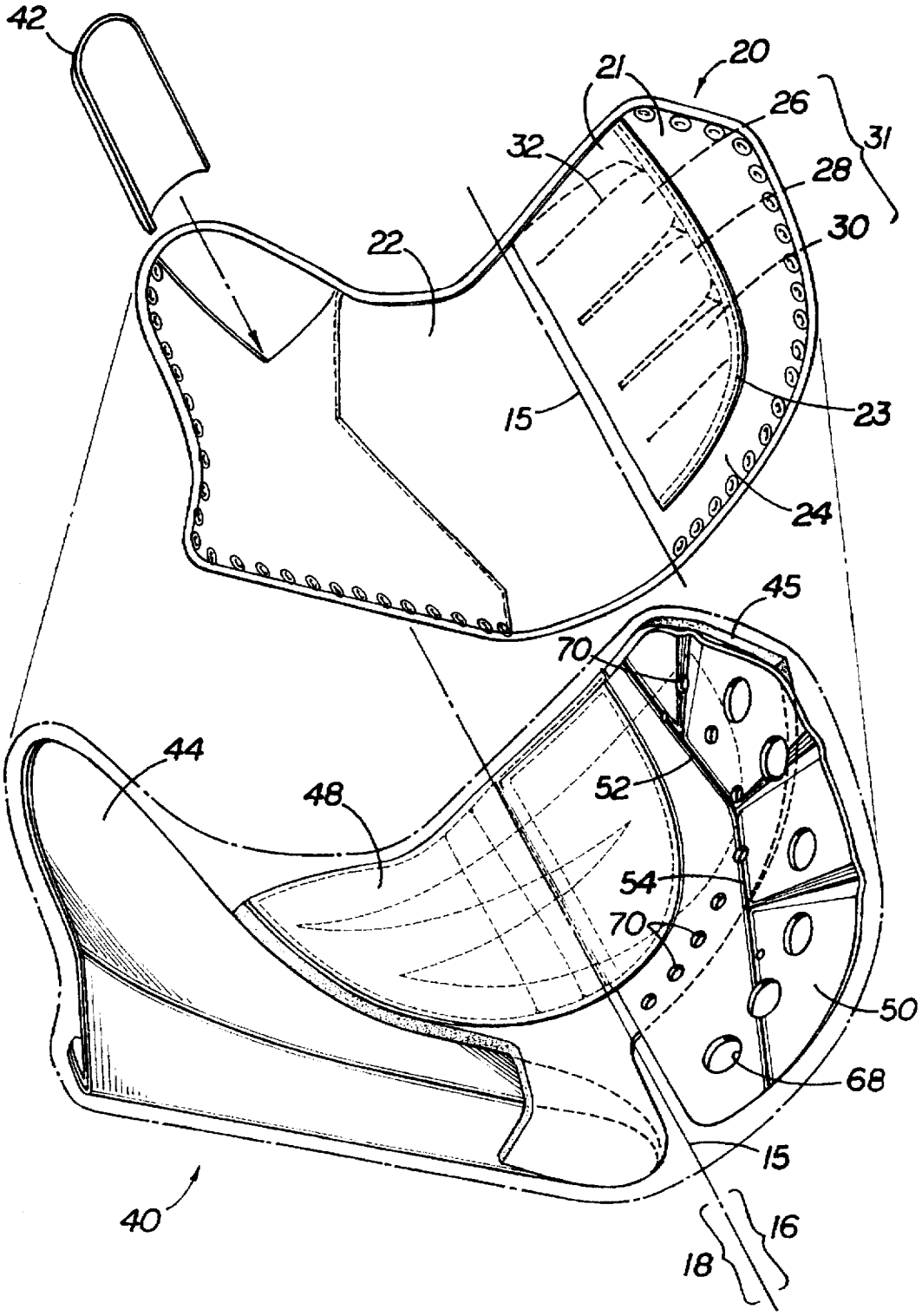
FIG. 3 is an exploded perspective of the concave catching side of the central pocket portion of the glove of FIG. 1.

FIG. 3 shows inner glove substructure 20 and stiffening substructure 40 of glove 10. Stiffening substructure 40 is preferably located between inner facing 19 and the wearer's hand and is most easily seen in FIGS. 3, 5, and 6. Stiffening substructure 40 easily bends along articulation axis 15. Stiffener 50 is secured by stitching to the distal side of stiffening substructure 40. The finger portion 16 of stiffening substructure 40 is held within glove 10 by lacing 25 (shown in FIG. 2) through lacing holes 70 and perimeter holes 68 (shown in FIGS. 3, 7). Thumb protector 44 is secured by lacing 25 to the proximal portion of stiffening substructure 40 and protects substantially the anterior side of the wearer's thumb, distal hand, and proximal wrist.

Stiffener 50 offers numerous advantages over prior designs including greater stiffness and a more effective shape in finger portion 16 and lighter weight near distal edge 17. Stiffener 50 is preferably made of polyethylene that is approximately one-eighth of an inch thick. Alternative materials for stiffener 50 include fiberglass and ABS plastic. Stiffener 50 is bent or curved along two or more axes such that it assumes a somewhat shell-like shape.

Figure 7:
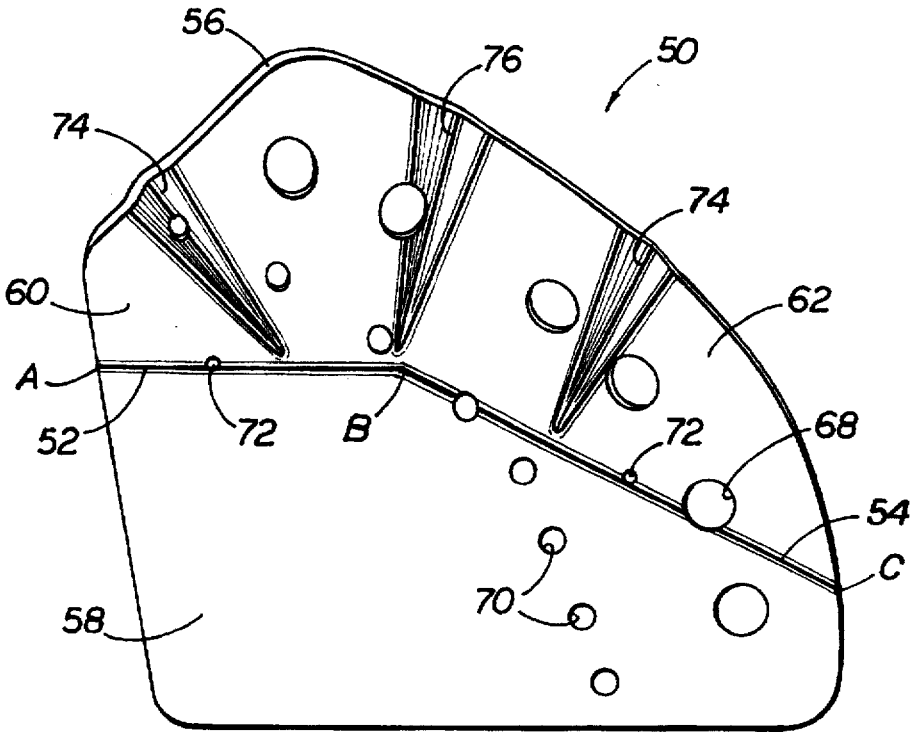
FIG. 7 is a perspective of the concave side of the stiffener that is located in the finger portion of the glove of FIG. 1.
Figure 8:
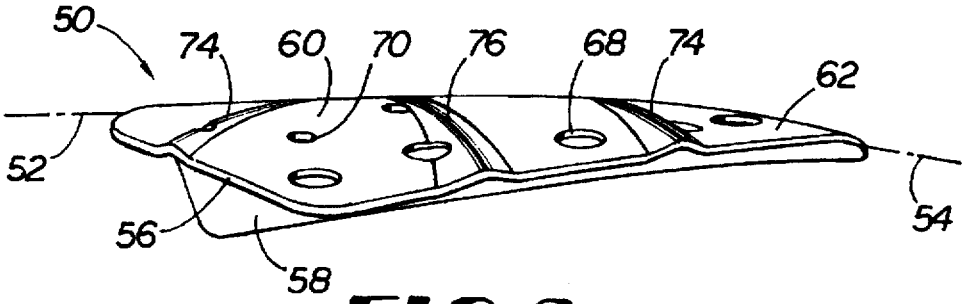
FIG. 8 is a perspective of the distal edge of the stiffener depicted in FIG. 7.

For example, a preferred embodiment of stiffener 50 is depicted in FIGS. 7 and 8. Stiffener 50 may be bent along first bend axis 52, the line labelled AB in FIG. 7, and second bend axis 54, the line labelled BC in FIG. 7. Stiffening ribs 74 may extend generally distally from first bend axis 52 and second bend axis 54. Stiffener 50 is divided into three sections, proximal section 58, lateral distal section 60, and medial distal section 62 by central stiffening rib 76 extending distally from point B and first and second bend axes 52 and 54. Stiffener 50 may, of course, contain more than three such sections. Alternatively, stiffener 50 may contain proximal section 58 connected to a distal section having a substantially continuously curved distal edge and surface instead of lateral distal section 60 and medial distal section 62.

Figure 9:
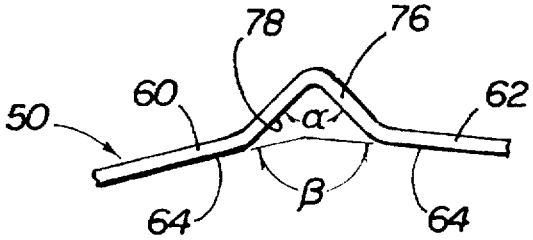
FIG. 9 is a detailed perspective of the distal edge of the stiffener depicted in FIG. 8.

FIG. 9 is a detailed view of stiffener distal edge 56 in the area surrounding central stiffening rib 76. Central stiffening rib 76 may be formed in stiffener 50 such that angle $\alpha$ formed by inner walls 78 of central stiffening rib 76 is less than angle $\beta$ formed by inner surfaces 64 of lateral distal section 60 and medial distal section 62. All stiffening ribs 74 preferably are formed such that their corresponding angles $\alpha$ are less than their corresponding angles $\beta$. However, stiffening ribs 74 may alternatively be made by incorporating a thicker section of material into stiffener 50. Stiffening ribs 74 resist bending of their longitudinal axes thus further increasing the ability of stiffener 50 to resist bending when struck near stiffener distal edge 56 by a puck or other object.

The shell-like shape of stiffener 50 with stiffening ribs 74 is more than ten times stiffer than conventional designs incorporating a polyethylene stiffener bent or curved along only one axis. Conventional designs with a single bend flatten under a force of approximately 14 pounds applied on the convex side with the stiffener resting on a hard surface concave side down. With stiffener 50 resting concave side down on a hard surface, stiffener 50 as shown in FIG. 7 can withstand a load of greater than approximately 150 pounds applied on the convex side above point B before flattening. Because of the superior stiffness of stiffener 50, it may include perimeter holes 68, which reduce the weight of stiffener 50. The lighter weight around the perimeter of stiffener 50 allows a goalie to rotate, position, and otherwise move and handle glove 10 more quickly, easily, and effectively.

Stiffener 50 is manufactured using a matched molding process that employs matching three-dimensional male and female metal plates corresponding to the final shape of stiffener 50. A pre-cut flat blank of polyethylene is positioned between the matched molds and held in place by guide pins (not shown) that are inserted through guide holes 72 shown in FIG. 7. The molds are heated and pressed against the blank such that three-dimensional stiffener 50 is formed.

Matched molding is considered superior to conventional injection molding because it preserves the uniform material characteristics of a one-piece, pre-cut polyethylene blank. Conventionally injection-molded polyethylene stiffeners can have local variations in their strength that make them far more brittle than stiffeners made with the matched molding process. However, injection molding processes may be employed if these local strength variations can be alleviated while molding polyethylene. Additionally, the matched molding dies are approximately one-quarter the cost of injection molding dies, which enables more cost effective design changes among other obvious advantages.

Stiffener 50 is preferably sewn between shock absorbing pad 45 preferably made of nylon or polyester felt and hinge pad 48 preferably made of a synthetic suede material such as that known under the brand name Nash Clarino™. Natural leather may be substituted for the synthetic suede but has been found to be inferior because imperfect sections of natural leather must be removed from the material before it may be used in a glove. Lacing, gluing, sewing, and combinations of lacing, gluing and sewing are included among the alternative methods of securing stiffener 50 between hinge pad 48 and shock absorbing pad 45. Shock absorbing pad 45 could also be made of a closed-cell, cross-linked polyurethane material known under the brand name Plastizote™.

Figure 4:
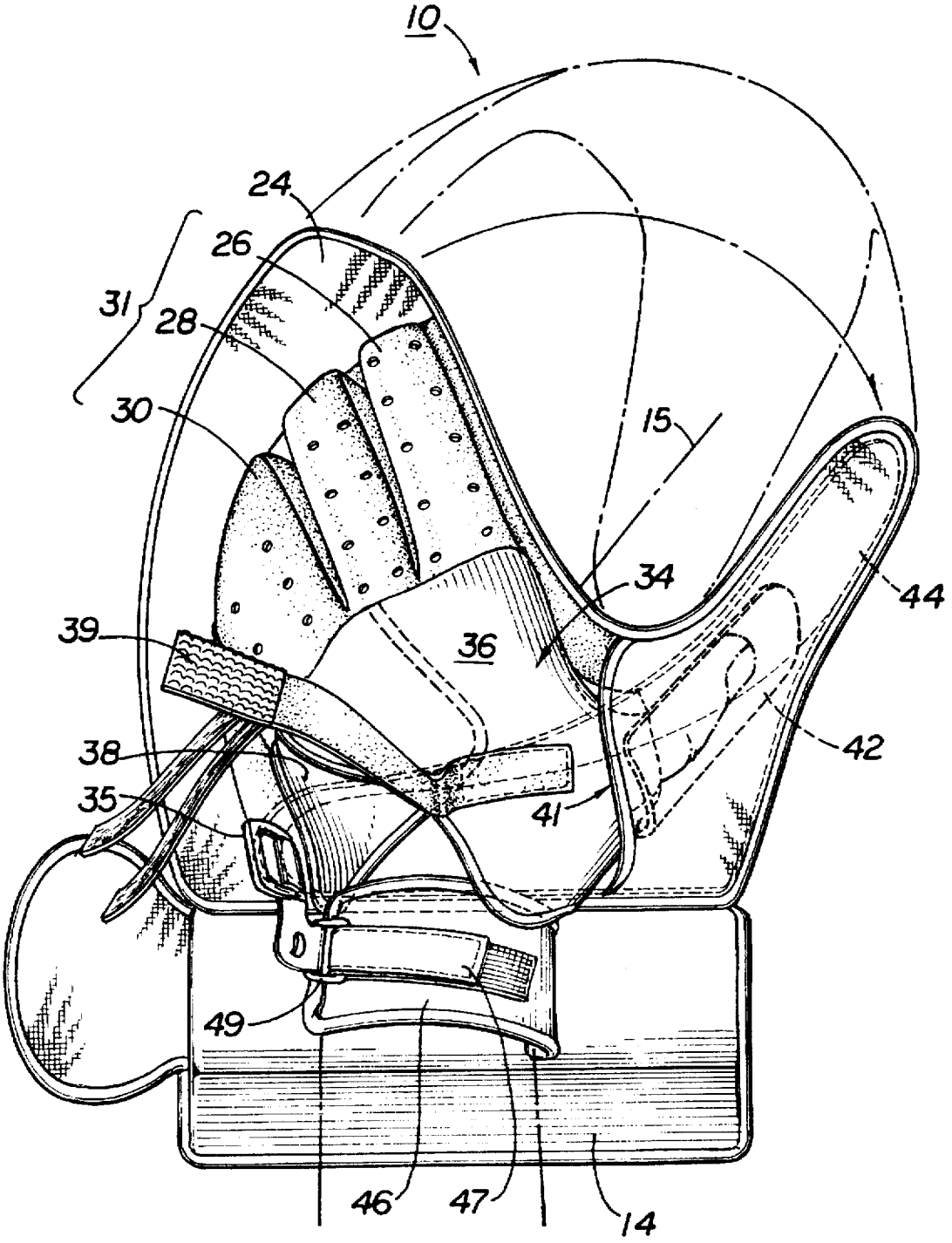
FIG. 4 is a cutaway perspective view of the convex non-catching side of the glove of FIG. 1 exposing the inner glove immediately surrounding the hand.
Figure 5:
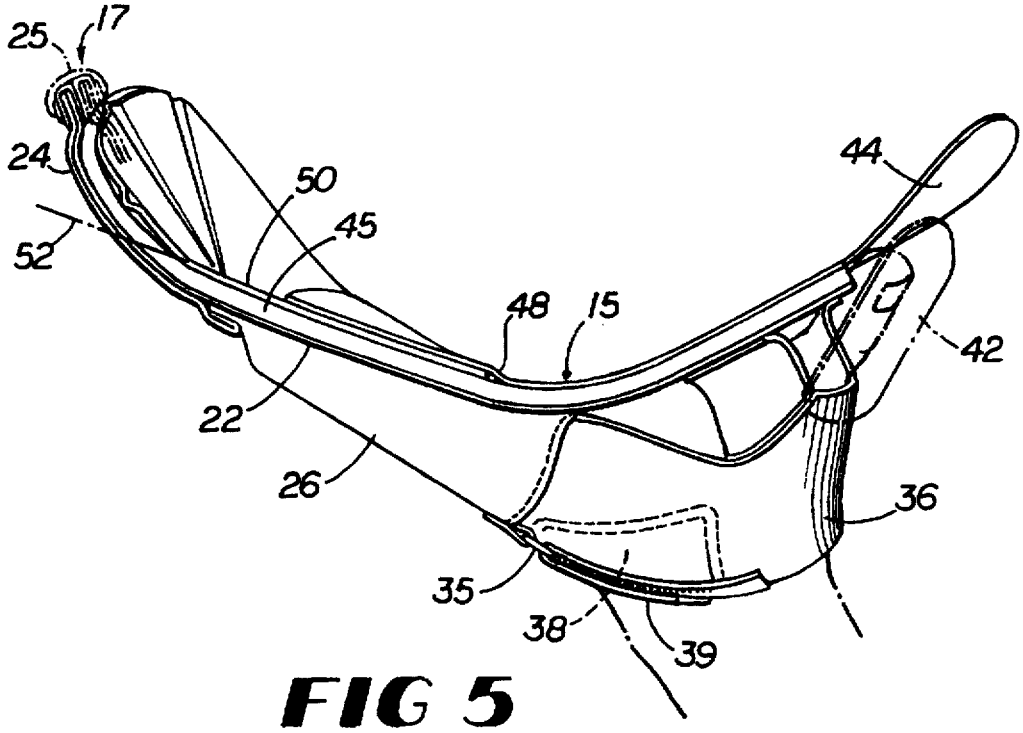
FIG. 5 is a perspective view of a part of the portion of the glove that is shown in FIG. 3 in an open position with a hand inserted in the inner glove.
Figure 6:
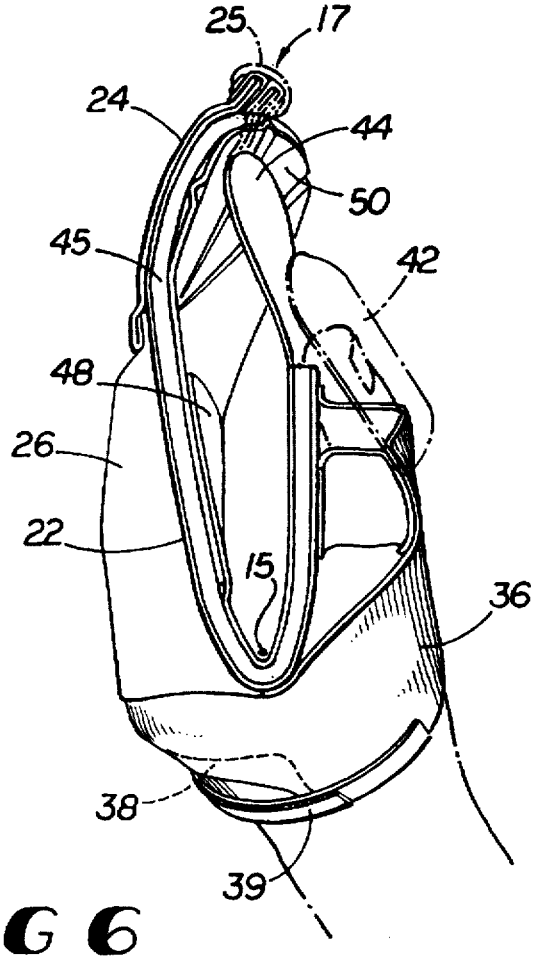
FIG. 6 is a perspective of the portion of the glove that is shown in FIG. 5 but in a closed position with a hand inserted in the inner glove.

The respective portions of hinge pad 48 and shock absorbing pad 45 within thumb portion 18 are preferably sewn together without intervention by stiffener 50. The assembled combination of the shock absorbing pad 45, hinge pad 48, and stiffener 50 may then be sewn, laced, glued, or a combination thereof into stiffening substructure 40. This structure allows stiffening substructure 40 to open and close around articulation axis 15 as shown in FIGS. 5 and 6 while maintaining the position of stiffener 50 within glove 10 as shown in FIG. 4.

In gloves according to the present invention, stiffener 50 interacts synergistically with inner glove substructure 20, which keeps the wearer's hand closely coupled with glove 10. A glove which incorporates stiffener 50 without also securing the wearer's hand sufficiently within the glove may prevent the wearer from maintaining sufficient control over such a glove. For instance, a puck striking the perimeter of a conventional glove employing stiffener 50 would impart considerably more force to the portion of the glove immediately surrounding the wearer's hand because of the added stiffness in the perimeter of the glove. Thus, such a glove would likely be nearly or completely pulled away from the wearer's hand. The glove of the present invention takes full advantage of the added stiffness around the perimeter of the glove created by stiffener 50 by incorporating inner glove substructure 20, which couples the wearer's hand more closely to the interior of glove 10.

Inner glove substructure 20 immediately surrounds the wearer's hand and is located between stiffening substructure 40 and outer facing 11. Palm 22 of inner glove substructure 20 is located between stiffening substructure 40 and the wearer's hand and is in contact with the wearer's palm and the anterior side of the wearer's fingers. Palm 22 is preferably made of synthetic leather but may be made of synthetic suede or natural leather. Palm 22 is attached to palm backing 24 by palm stitching 23 to form intermediate support piece 21. Intermediate support piece 21 is secured within glove 10 by lacing 25 as shown in FIG. 2.

Index finger stall 26, middle finger stall 28, and ring and small finger stall 30 (collectively "finger stalls 31") preferably are attached to palm 22 by finger stall stitching 32 such that finger stalls 31 and palm 22 form three spaces for the wearer's fingers. An inner glove substructure may incorporate from one to four similarly constructed finger stalls. Finger stalls 31 are preferably made of synthetic suede (Nash Clarino™), but may be made of synthetic leather, leather, or a nylon/lycra-covered neoprene laminate or an equivalent. Thumb stall stiffener 42 provides the shape of thumb stall 41 and protects substantially the posterior side of the wearer's thumb.

The finger stalls 31 in inner glove substructure 20 fit more tightly around the wearer's fingers than in conventional gloves, thus keeping the fingers and distal end of the palm in closer contact with palm 22. The tighter-fitting finger stalls 31 are made possible by the elastomeric properties of the nylon/lycra-covered neoprene laminate used in elastomeric retainer 34 as explained further below. A preferable form of such laminate for use in elastomeric retainer 34 is ⅛ inch thick and is known under the brand name Rubatex™ N2 R-1400-N. The exterior covering of the laminate is a nylon/lycra fabric but could alternatively be nylon, polyester, or other fabrics either alone or combined with lycra. This fabric lining allows the wearer's hand to be more easily inserted and removed from glove 10.

The posterior side of inner glove substructure 20 is most easily seen in FIG. 4. Elastomeric retainer 34 is divided into lateral retainer portion 36 and medial retainer portion 38, which overlap as shown in FIG. 4. The overlap allows the glove to accommodate a wider range of hand sizes and prevents puckering, folding, and binding when hand retainer strap 39 is tightened across the back of the wearer's hand. The overlap between lateral and medial retainer portions 36 and 38 also allows the wearer to adjust the snugness of elastomeric retainer 34 as the neoprene relaxes in use over time.

When worn by a hockey goalie, the distal edge of lateral retainer portion 36 extends approximately from the proximal end of the smallest finger to the proximal interphalangeal joint of the index finger to the distal interphalangeal joint of the thumb. The proximal edge of lateral retainer portion 36 extends approximately from the midpoint of the posterior wrist to the metacarpophalangeal joint of the thumb to the proximal interphalangeal joint of the thumb. The distal edge of medial retainer portion 38 extends approximately from the medial side of the hand at the proximal end of the smallest finger to the posterior side of the proximal end of the ring finger. The proximal edge of medial retainer portion 38 extends approximately from the medial wrist to the mid point of the posterior wrist.

Thus, elastomeric retainer 34 will stretch across the posterior sides of the metacarpophalangeal joints of the wearer's fingers and the rest of the posterior side of the wearer's hand as glove 10 is closed. This elastomeric stretching allows finger stalls 31 to fit the wearer's fingers more tightly than finger stalls in conventional gloves. The shape of elastomeric retainer 34 of the present invention may, of course, vary from the description above provided that finger stalls 31 do not bind on the wearer's fingers as glove 10 is closed.

Hand retainer strap 39 is preferably connected to lateral retainer portion 36 at one end, inserted through body cinch loop 35, and folded onto itself to engage a hook-and-loop fastener. Such an arrangement of hand retainer strap 39 helps to keep the wearer's hand secured within elastomeric retainer 34. For example, hand retainer strap 39 may be located more distally than straps spanning the posterior of the wearer's hand in conventional designs without impairing the wearer's ability to close the glove. As the wearer's hand is closed as in FIG. 6, lateral retainer portion 36 stretches at the point where hand retainer strap 39 is connected, which effectively allows hand retainer strap 39 to expand. This relatively distal location of hand retainer strap 39 keeps the wearer's palm in closer contact with palm 22 and provides the wearer with superior control over glove 10. However, attaching hand retainer strap 39 to other portions of the glove or in another manner such that hand retainer strap 39 does not significantly impair the wearer's ability to close the glove does not depart from the spirit or scope of the invention.

Wrist retainer strap 46 is preferably a padded nylon strap that is secured around the wearer's wrist with wrist strap closure 47. Wrist strap closure 47 preferably is connected to wrist retainer strap 46 at one end, inserted through wrist cinch loop 49, and folds upon itself to engage corresponding hook and loop fasteners. Of course, variations on the means of securing wrist retainer strap 46 about the wearer's wrist may be made without departing from the scope of the invention.

FIGS. 5 and 6 are illustrations in which the relationships between inner glove substructure 20 and stiffening substructure 40 and between stiffener 50 and thumb protector 44 are shown. In FIG. 5 the wearer's hand is open and the shape of stiffener 50, which is bent around first bend axis 52 and second bend axis 54 is apparent. Inner glove substructure 20 and stiffening substructure 40 are held together at least by lacing 25 shown at distal edge 17. As the wearer closes glove 10 along articulation axis 15, the overlap between thumb protector 44 and stiffener 50 is apparent. Also apparent is the curvature of stiffener 50 inward toward articulation axis 15. This curvature provides the concave shape of pocket portion 13 that so effectively stiffens finger portion 16 and deflects objects toward pocket portion 13 and web 12.

The foregoing is provided for the purposes of description rather than limitation. Changes, modifications, or adaptations may be made to the sports catch glove and components described in the foregoing and the remainder of this document without departing from the scope or spirit of the invention.

I claim:

1. A glove for use in catching fast-moving objects, comprising:

an inner facing adapted to catch and retain the objects and corresponding generally to the shape of the anterior side of the wearer's hand and extending distally from the distal ends of the wearer's fingers and thumb;

b. an outer facing connected to the inner facing and generally corresponding to the shape of the posterior side of the wearer's hand;

c. an interior portion formed between the inner facing and the outer facing;

d. an intermediate support piece that is
   i) attached to the interior portion and
   ii) made of a substantially nonexpansible material; and e. an inner glove adapted to contain substantially the wearer's entire hand comprising
   i) a plurality of stalls that are
      A. connected to the intermediate support piece and
      B. adapted to receive at least some of the wearer's fingers and one of the wearer's thumbs, and
   ii) an elastomeric retainer that is
      A. connected to the stalls and to the intermediate support piece, and
      B. adapted to cover a substantial portion of the back, but not the palm or the distal portions of the fingers and thumb, of the wearer's hand and to conform in shape to at least a substantial portion of the back of the wearer's hand.

2. A glove according to claim 1 further comprising a hand retainer strap that a. spans at least a portion of the elastomeric retainer in the vicinity of the back of the wearer's hand, and b. cooperates with the elastomeric retainer in pressing the palm of the wearer's hand against the intermediate support piece such that force and control is imposed onto at least a portion of the pocket portion.

3. A glove according to claim 1 in which the elastomeric retainer further comprises a medial retainer portion and a lateral retainer portion that a. are connected to the intermediate support piece and to the stalls and b. at least partially overlap in the vicinity of the midline of the posterior side of the wearer's hand.

4. A glove according to claim 1 in which the elastomeric retainer further comprises:

a. a first edge defining a first length and b. a second edge defining a second length, in which the first edge and the second edge are connected to the intermediate support piece along substantially the entire first length and along a significant portion of the second length.

5. A glove according to claim 2 in which the elastomeric retainer further comprises a medial retainer portion and a lateral retainer portion that a. are connected to the intermediate support piece and to the stalls and b. at least partially overlap in the vicinity of the midline of the posterior side of the wearer's hand.

6. A glove according to claim 2 in which the elastomeric retainer further comprises:

a. a first edge defining a first length and b. a second edge defining a second length, in which the first edge and the second edge are connected to the intermediate support piece along substantially the entire first length and along a significant portion of the second length.

7. A glove according to claim 6 in which the elastomeric retainer further comprises:

a. a medial retainer portion that extends from the first edge and b. a lateral retainer portion that
   i) extends from the second edge and
   ii) overlaps, at least partially, the medial portion near the midline of the posterior side of the wearer's hand.

8. A glove for catching fast-moving objects, comprising:

a. an inner facing adapted to catch and retain the objects and corresponding generally to the shape of the anterior side of the wearer's hand and extending distally from the distal ends of the wearer's fingers and thumb;

b. an outer facing connected to the inner facing and generally corresponding to the shape of the posterior side of the wearer's hand;

c. an interior portion formed between the inner facing and the outer facing;

d. a thumb stall that is:
   i) made of a substantially nonexpansible material,
   ii) connected to the interior portion, and
   iii) adapted to receive a portion of the wearer's thumb;

e. a finger stall that is:
   i) made of the nonexpansible material,
   ii) connected to the interior portion, and
   iii) adapted to receive a portion of one of the wearer's fingers; and f. an elastomeric retainer that is:
   i) connected to the interior portion and
   ii) adapted to cover the wearer's hand from approximately the wrist to approximately the mid-points of the proximal phalanges of the wearer's hand.

9. A glove according to claim 8 in which:

a. the thumb stall further comprises a thumb stall proximal edge that is connected to the elastomeric retainer and b. the finger stall further comprises a finger stall proximal edge that is connected to the elastomeric retainer.

10. A glove according to claim 8 in which the elastomeric retainer covers only the posterior side of the wearer's hand and further comprises:

a. a first edge defining a first length and b. a second edge defining a second length, in which the first edge is connected to the interior portion along substantially the entire first length and the second edge is connected to the interior portion along substantially the entire second length.

11. A glove according to claim 10 in which:

a. the thumb stall further comprises a thumb stall proximal edge that is connected to the elastomeric retainer and b. the finger stall further comprises a finger stall proximal edge that is connected to the elastomeric retainer.

12. A glove according to claim 11 in which the elastomeric retainer further comprises:

a. a medial retainer portion that extends from the first edge and b. a lateral retainer portion that
   i) extends from the second edge and
   ii) overlaps, at least partially, the medial portion near the midline of the posterior side of the wearer's hand.

13. A glove for use in catching fast-moving objects, comprising:

a. an inner facing adapted to catch and retain the objects and corresponding generally to the shape of the anterior side of the wearer's hand and extending distally from the distal ends of the wearer's fingers and thumb;

b. an outer facing connected to the inner facing and generally corresponding to the shape of the posterior side of the wearer's hand;

c. an interior portion formed between the inner facing and the outer facing;

d. an intermediate support piece that is:
   i) connected to the interior portion and
   ii) made of a substantially nonexpansible material; and e. a plurality of finger stalls, each having a proximal end, that are:
   i) connected to the intermediate support piece and
   ii) adapted to receive a portion of the wearer's thumb and a portion of at least one of the wearer's fingers; and f. an elastomeric retainer having a distal edge such that the elastomeric retainer is:
   i) connected to the intermediate support piece,
   ii) connected to the finger stalls along a portion of the distal edge adjacent the proximal ends of the finger stalls, and
   iii) adapted to cover the wearer's hand from approximately the wrist to approximately the mid-points of the proximal phalanges.

14. A glove according to claim 13 in which the elastomeric retainer covers only the posterior side of the wearer's hand and further comprises:

a. a first edge defining a first length and b. a second edge defining a second length, in which the first edge is connected to the intermediate support piece along substantially the entire first length and the second edge is connected to the intermediate support piece along substantially the entire second length.

15. A glove according to claim 14 in which the elastomeric retainer further comprises:

a. a medial retainer portion that extends from the first edge and b. a lateral retainer portion that
   i) extends from the second edge and
   ii) overlaps, at least partially, the medial portion near the midline of the posterior side of the wearer's hand.

* * * * *